United States Patent [19]

Fowler

[11] 4,407,530

[45] Oct. 4, 1983

[54] PACKOFF APPARATUS

[75] Inventor: John H. Fowler, Houston, Tex.

[73] Assignee: Smith International, Inc., Newport Beach, Calif.

[21] Appl. No.: 219,253

[22] Filed: Dec. 22, 1980

[51] Int. Cl.[3] ..... E21B 33/04

[52] U.S. Cl. ..... 285/140; 285/356

[58] Field of Search ..... 285/140, 356, 351, 139, 285/141; 277/116.2, 116.4, 116.6, 116.8, 117, 120, 121, 122

[56] References Cited

U.S. PATENT DOCUMENTS

| | | | |
|---|---|---|---|
| 884,749 | 4/1908 | Mason | 285/356 X |
| 2,306,831 | 12/1942 | Proctor | 285/140 X |
| 2,437,632 | 3/1948 | Wolfram | 285/351 X |
| 2,471,658 | 5/1949 | Shaffer et al. | 285/356 X |
| 2,747,899 | 5/1956 | Wiltse | 285/351 X |
| 3,273,646 | 9/1966 | Walker | 285/140 X |
| 3,528,686 | 9/1970 | Nelson | 285/321 X |
| 3,809,158 | 5/1974 | Bonds et al. | 285/142 X |
| 3,895,831 | 7/1975 | Fisher | 285/351 X |
| 4,019,579 | 4/1977 | Thuse | 166/123 |
| 4,324,422 | 4/1982 | Rains et al. | 285/140 |

*Primary Examiner*—Thomas F. Callaghan

*Attorney, Agent, or Firm*—Ned L. Conley; David Alan Rose; William E. Schull

[57] ABSTRACT

A sealing assembly is releasably disposed on a hanger suspending a string of casing or tubing into a well. A shoulder on the hanger engages a seat in the bore of the wellhead and has passages therethrough for connecting the annular spaces above and below the seat. The seal assembly is lowered into the upper annular space around the hanger to close the annulus. The assembly includes a first tubular body threadingly connectable to the hanger, an outer load ring, an inner load ring, an inner packing ring disposed between the outer load ring and inner load ring, an inner retainer ring, and an outer packing ring disposed between the inner load ring and retainer ring. The inner packing ring singly engages the hanger and the outer packing ring singly engages the head. Such sealing occurs in series. The entire sealing force is applied through the outer diameter and inner diameter seal elements with the lower seal being loaded first. Even when one seal assembly is fully compressed, compression of the other seal assembly may continue.

17 Claims, 7 Drawing Figures

PACKOFF APPARATUS

TECHNICAL FIELD

This invention relates to underwater casing hanger apparatus, and more particularly, to packoff assemblies for sealing the annulus between the suspended string and the wellhead.

BACKGROUND OF THE ART

In the drilling of an underwater oil and gas well, it is common to install a series of coaxial casing assemblies extending into the ocean floor to different depths and suspended by a casing hanger mounted at the mudline within the wellhead or a hanger head disposed within the wellhead. An inner hanger apparatus will have a first device for automatically engaging a second device on the wellhead or an outer hanger head, as the case may be, during the time such inner hanger, suspending a string of tubing or casing, is being lowered into the well and so as to prevent further downward movement of such inner hanger and string.

In such installations, pressure control equipment is connected to the upper end of the wellhead, and the string is lowered into the well through such equipment for suspension from the wellhead. To lower the string, the hanger, connected to the upper end of the casing or tubing string, has means thereon for releasable connection to a running tool suspended from the lower end of a pipe string extending to the surface, and, as discussed above, a seat thereabout for landing on a seat in the bore of the wellhead as it is lowered by the tool, the coaxial casings forming an annulus.

Although reliance may be had on the weight of the casing or tubing to hold the hanger down within the well after it has landed, generally it is desirable to lock the hanger and string. Conventionally, means for locking the respective casing hangers in the wellhead housing are carried by the wellhead or outer hanger head and automatically interlock with an inner hanger when the inner hanger is landed within the wellhead.

Various prior art patents disclose means for locking a hanger down within the wellhead including U.S. Pat. Nos. 3,273,646; 3,404,736; 3,468,558; 3,468,559; 3,489,436; 3,492,026; 3,528,686; 3,664,689; 3,800,869; 3,827,488; and 3,918,747. However, most prior art devices do not provide for a positive holddown where the locking ring or latch is prevented from expanding or contracting so as to unlock the hanger within the well. Those which provide a type of positive holddown are in combination with a seal assembly where the positive holddown is not effected until the seal assembly is actuated. Such holddowns are then dependent upon the life of the seal ring in the assembly. See, for example, U.S. Pat. Nos. 3,404,736; 3,540,533; 3,664,689; 3,809,158 and 4,138,144.

Most prior art holddown latches include a sealing assembly which is subjected to the deleterious effects of the circulating cement and returns during the cementing operation. See, for example, U.S. Pat. Nos. 3,404,736; 3,528,686; 3,540,533; 3,664,689; 3,809,158; 3,827,488; and 3,918,747. This is true even where the holddown assemblies are independent of the seal assemblies. See U.S. Pat. Nos. 3,468,558; 3,468,559; 3,489,436; 3,492,026; and 3,827,488. Although U.S. Pat. No. 3,273,646 does not subject its sealing assembly to circulation, neither does it provide a positive holddown during the cementing operation.

The cementing operation includes anchoring the hanger and string in place by means of the cement which is conducted downwardly through the handling string and upwardly into the annulus between the suspended string and the well bore. There are flow passages through the hanger which connect the annulus with the bore of the wellhead above the seat so that returns may be taken up through the flow passages.

The cementing of a casing string within a wellhead structure is a difficult operation that is both costly and time consuming. Among the difficulties is the problem of insuring a solid cementing operation of the casing string within the incased portion of the hole and still providing a reliable means of effecting a secondary seal at the hanger. Many cementing systems operate on a volumetric basis wherein a predetermined amount or volume of cement is pumped into the well and allowed to flow up around the casing string to permanently secure it in place. However, leaks or cracks in the wellhead structure or ruptured strata of the hole itself may drain off a portion of the cement thereby preventing an adequate cementing of the casing. Should this crack or leak occur near the bottom of the hole, virtually all the cement may be drained off or lost from the annulus around the casing, thereby putting greater reliance on the secondary seal at the hanger to prevent any leakage of down hole pressure.

Proper completion of the well requires that the annulus formed by adjacent casings, be sealed off above the cement line after the cement has been forced into the annulus. Such a seal has been effected in the prior art by packoff assemblies that include a compressed seal element. See, for example, U.S. Pat. Nos. 3,273,646; 3,404,736; 3,468,558; 3,468,559; 3,489,436; 3,492,026; 3,528,686; 3,664,689; 3,800,869; 3,827,488; 3,918,747; 4,109,942; and 4,138,144. Such patents show a packoff assembly with a seal element disposed between an upper compression member and a lower compression member. In those disclosures, it can be seen that as a load is placed on the packoff assembly, downward movement of the lower compression member will eventually be precluded by stop means. By continuing the downward movement of the upper compression member, the seal element is compressed thereby expanding to seal against the hanger and head, thus sealing off the annulus.

Sealing off the cemented annulus around the casing is difficult in prior devices because the abrasive effect of liquids and solids displaced by cement sometimes rips or damages the seals, thereby preventing an effective seal. Furthermore, when seals are forced across threaded portions of the casing hanger, additional ripping, tearing or damage of the seals can occur.

U.S. Pat. No. 3,404,736 discloses an integral support ring/packoff assembly. This assembly includes an upper tubular member and a lower tubular member which are made up with one another by means of threads disposed about the upper end of the lower member and threads disposed about an intermediate portion of the upper member. The lower member has threads about its lower end for making up with intermediate threads on the hanger located above the annular seat supporting the hanger within the wellhead and below the running tool threads. The running tool threads are arranged radially inwardly on the hanger so that the lower tubular member is free to move downwardly over the running tool threads on the hanger and into position for engagement with the intermediate threads on the hanger.

The upper member is releasably attached to the running tool by means of pins projecting outwardly from the running tool for fitting within grooves about the upper end of the upper tubular member. These pins not only permit the entire assembly to be lowered onto the casing hanger, but also permit it to be rotated for anchoring thereto by the engagement of the intermediate hanger threads. The upper and lower tubular members are releasably connected against rotation related to one another by means of one or more shear pins so that a right-hand torque transmitted on the running tool by the drill string will be transmitted to the upper member and thus to the lower member for making up the intermediate threads on the hanger.

There is a frustoconical shoulder around the outer circumference of the lower tubular member positioned so as to be opposite an internal groove in the bore of the wellhead. There is a rigid split ring disposed above the shoulder on the lower member for radial expansion into the annular groove. An expander ring, which also functions as a lower compression ring for the seal assembly, has a cooperative tapered surface engaging a taper on the upper surface of the split ring where, upon the downward movement of the expander ring, the split ring is expanded radially outwardly into the annular groove to relieve the axial load of the hanger and string on the wellhead.

The seal assembly includes the expander ring as the lower compression member and a seal ring mounted around the lower tubular member and located above the expander ring. On top of te seal ring is an anti-friction ring whose upper surface engages the lower end of the upper tubular member.

To actuate the assembly, a right-hand torque is placed on the running tool causing the upper tubular member to move downwardly thereby expanding the split ring and energizing the seal ring. However, as has been pointed out, there is no positive holddown during the cementing operation and the suppot provided by the split ring is dependent upon the life of the seal ring. Further it should be noted that the purpose of the split ring is not to serve as a holddown but as an axial support to relieve part of the load on the hanger.

The prior art packoff assembly requires the dual sealing engagement of both the hanger and the wellhead. Should the packoff assembly fail to be centered within the annular recess formed by the hanger and the wellhead, the sealing assembly may engage only one of the sealing surfaces. This may result from the sealing element failing to sufficiently expand in one of the radial directions to contact a sealing surface.

The packoff assembly of the present invention is independent of the holddown and can be installed and the cemented annulus selectively sealed off, after the proper cementing job has been performed. The sealing means of the packoff assembly is never subjected to the abrasive effect of the fluid cement and is never forced across threads of other surfaces which may damage or have a deleterious effect on such sealing means. Such sealing means may then act as an effective, reliable, positive secondary seal supplementing the seal provided by the cemented annulus. The packoff assembly of the present invention operates in series whereby an inner sealing means sealingly engages the hanger independently of an outer sealing means engaging the wellhead.

Other objects and advantages of the invention will appear from the following description.

DISCLOSURE OF THE INVENTION

The present invention includes a sealing assembly adapted for mounting on a hanger. The hanger suspends a string of casing or tubing for lowering same into a well on a running tool. A shoulder on the hanger engages a seat in the bore of the wellhead and has passages therethrough for connecting the annular spaces above and below the seat.

The seal assembly is lowered into the upper annular space around the hanger to close the annulus. The assembly includes a first tubular body threadingly connectable to the hanger, an outer load ring, an inner load ring, an inner packing ring disposed between the outer load ring and inner load ring, an inner retainer ring, and an outer packing ring disposed between the inner load ring and inner retainer ring. The inner packing ring singly engages the hanger and the outer packing ring singly engages the head. Such sealing occurs upon the shearing of a pin having relative vertical movement between the hanger and head. A running tool has threads for attachment to the hanger.

BRIEF DESCRIPTION OF THE DRAWINGS

For a detailed description of a preferred embodiment of the invention, reference will now be made to the accompanying drawings wherein.

DESCRIPTION OF THE PREFERRED EMBODIMENT

Figure 1:
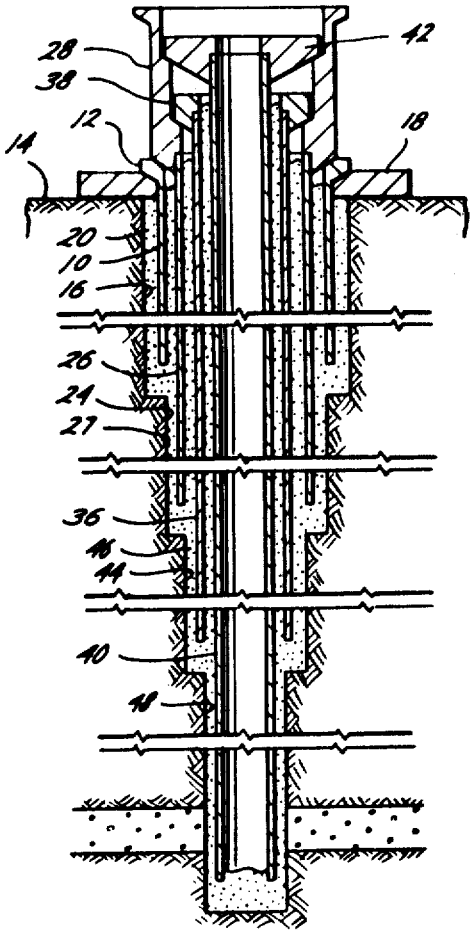
FIG. 1 is a schematic view of the cross section of suspended coaxial casing assemblies in an underwater well.

The present invention is an apparatus for sealing off the annulus between a casing hanger and a casing head in an oil and gas well. Although the present invention may be used in a variety of environments, FIG. 1 illustrates the environment of the present invention installed in an offshore well on the ocean floor. Such installations ordinarily include a series of coaxial assemblies including casing extending into the ocean floor supported by casing hangers mounted within a wellhead or casing head disposed on a base at the mudline.

Referring now to FIG. 1, a conductor casing 10 and head 12 have been lowered from a drilling means (not shown) such as a barge or bottom-supported platform and installed into the ocean floor 14. The conductor casing 10 may be driven or jetted into the ocean floor 14 until head 12 rests near the mudline, or if the bottom conditions so require, a bore hole 16 may be drilled for the insertion of conductor casing 10. A base structure 18 secured about the upper end of conductor casing 10 rests on the ocean floor 14, and the conductor casing 10 is enclosed within bore hole 16 by a column of cement 20 about at least a substantial portion of its length. A riser (not shown) clamped to head 12 extends from head 12 to the drilling means (not shown).

After drilling apparatus is lowered through the riser and conductor casing 10 to drill a new bore hole 24, surface casing 26, having a wellhead housing 28 attached to its upper end, is lowered through the riser and conductor casing 10 until housing 28 lands on head 12. Surfce casing 26 has its lower end anchored within te well by cement 27. Casing head or wellhead housing 28 may be of various designs such as for suspending casing hangerheads which support other casing hangerheads or for supporting multiple casing hangers such as are shown in FIG. 1.

Pressure control equipment is releasably connected to the well either at the ocean floor or at the surface. When located at the surface, the equipment is mounted to the riser extending from the upper end of wellhead housing 28. When located at the ocean floor, the equipment (not shown) is connected directly to the upper end of wellhead housing 28, and has a riser (not shown) extending upwardly to the water's surface. Assuming the latter, such pressure control equipment includes one or more blowout preventors and forms a continuous bore of substantially the same diameter as the upper end of the bore of the wellhead housing 28. The details of the pressure control equipment and its riser are not important to the novel aspects of the present invention and therefore are not described in detail. It is sufficient to note that one or more casing strings may be lowered into and landed within wellhead housing 28 for suspension within the well, as hereinafter described while maintaining pressure control over the well.

Referring again to FIG.1, intermediate casing 36 with casing hanger 38, and production casing 40 with casing hanger 42, are successively installed within the well. Bore hole 44 is first drilled into the ocean floor within which intermediate casing 36 is lowered and cemented as at 46 and then bore hole 48 is drilled for suspending and cementing production casing 40. Casing hanger 38 and casing hanger 42 are individually supported by wellhead housing 28.

Thus, the series of coaxial casing assemblies are installed in the well beginning with the outermost or conductor casing 10 and concluding with production casing 40. Generally, the installation includes drilling a bore hole having a diameter slightly greater than the casing to be installed and lowering the casing string from the drilling means through a riser and the previously installed casing and into the newly drilled bore hole. The casing is suspended from the wellhead housing by the casing hanger and the casing is anchored within the well by the cement.

One or more tubing strings would subsequently be installed inside the production casing if the well is out into production, and would be suspended and sealed using a tubing hanger and one or more packers to isolate the producing zone from one another. An assembly of production valves would then be connected to wellhead housing 28 in place of the pressure control equipment to control flow from the well.

Having now described the general environment of the present invention, it is now necessary to describe the cementing operation. It should be understood that a description of the cementing of one casing string will be illustrative of the method of cementing the other casing strings and therefore the following detailed description of the cementing of the intermediate casing 36 will be exemplary of that operation for surface casing 26 and production casing 40.

Figure 2:
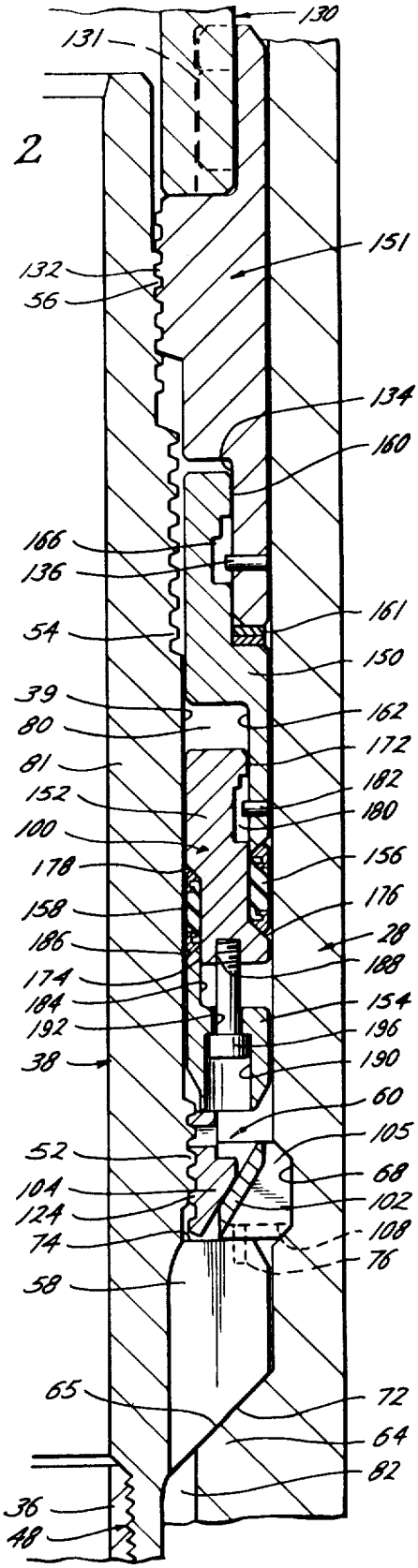
FIG. 2 is a section view of a portion of the hanger, head, running tool, and seal assembly for the underwater well of FIG. 1.

Referring now to FIG. 2, wellhead housing 28 includes an internally projecting annular shoulder 64, forming a lower conical seat 65 having a generally upwardly facing ridge surface, and an annular holddown groove 68 spaced a predetermined distance above shoulder 64. Groove 68 may have a single upper and lower external frustoconical load-bearing surface or a plurality of upper and lower external frustoconical load-bearing surfaces. A plurality of such surfaces is often necessary on some wellheads where very high blowout forces can exist. Hanger 38 includes a mandrel 81 having a threaded box at 48 at its lower end for threaded connection to the upper end of casing string 36. Above box 48, hanger 38 has a plurality of azimuthally-spaced ribs 58 formed by flow passages or flutes. The lower annular surface of ribs 58 forms an upper conical seat 72 adapted to engagingly mesh with lower conical seat 65 of shoulder 64.

Ribs 58 also form an annular shoulder 74, each having an upwardly projecting pin 76. Hanger 38 includes right-hand threads 52 just above ribs 58 for effecting holddown assembly 60, described below, left-hand threads 54 above threads 52 for threaded engagement with the holddown assembly running tool (not shown), and right-hand threads 56 above threads 54 for connection with a riser (not shown).

During installation, casing hanger 38, having surface casing 36 suspended from its lower end, is lowered by the holddown assembly running tool, and seat 72 of ribs 58 are landed on seat 65 of inwardly projecting annular shoulder 64 in the bore of wellhead housing 28. With casing hanger 38 so landed, casing string 36 is suspended within surface casing 26 and bore hole 44 in spaced relation thereto creating an annulus thereabout which extends from the bottom of bore 44 to the surface.

The physical dimensions of hanger 38 and wellhead housing 28 and their various components is such that when seats 65, 72 engage, shoulder 74 will be approximately even with the lower porton of groove 68 in wellhead housing 28, and there will be a substantially clear passage from the upper annulus 80 above ribs 58 to the lower annulus 82 below ribs 58 through the flow passges created by ribs 58.

Hanger holddown assembly 60 is lowered into the well on hanger 38 with running tool (not shown) and actuated by a right-hand torque applied to the running tool drill string and transmitted to assembly 60. Upon actuation, assembly 60 positively locks seat 72 of ribs 58 against annular seat 65 of shoulder 64 on wellhead housing 28 thereby preventing the upward movement of hanger 38.

As can be best visualized from FIG. 1, the drill pipe (not shown) extends from the casing hanger 38 to the surface so that cement may be pumped downwardly through the drill pipe and through casing 36 around the lower end of casing 38 and upwardly within lower annulus 82 around the exterior of casing 36. During the cementing operation, returns are taken upwardly through lower annulus 82, through the flow passages or flutes, and into upper annulus 80.

After complete actuation of holddown assembly 60, a portion of the assembly 60 is removed with the remaining portion continuing to maintain positive holddown as shown in FIG. 2. A seal assembly or packoff 100, hereinafter described in detail, is then lowered through the riser and onto mandrel 81 into annulus 80 for closing and sealing the flow passages around ribs 58. The seal assembly 100 is lowered by means of another running tool suspended from the lower end of a drill string. In summary, the hanger holddown 60 holds hanger 38 down against wellhead housing 28 and the packoff assembly 100 seals off upper annulus 80 from lower annulus 82 closing the flow passages. It is an especially desirable feature that the packoff assembly 100 operate entirely independent of the holddown assembly 60. Although the holddown is effected before the packoff is even run into the well, it should be understood that the holddown and packoff may be adapted to be combined and lowered into the well as a unit and be used together.

Referring to FIG. 2, the portion of holddown assembly 60 remaining includes a latch ring 102 and locking ring 104. Latch ring 102 rests on the upper shoulder 74 of ribs 58 of hanger 38 and has ribs 105 defined by bypass grooves which correspond to the flow passages of hanger 38. Each rib 105 has a radially-extending slot 108 on its lower surface for receiving pin 76 on each corresponding rib 72 of hanger 38 to prevent rotation of ring 102 with respect to hanger 38. Latch ring 102 further has a bevelled inner surface and is split to permit expansion.

Locking ring 104 has internal right-hand threads 124 for threaded engagement with threads 52 of hanger 38. As locking ring 104 is tightened onto threds 52 by right-hand rotation, locking ring 104 moves downwardly causing latch ring 102 to expand radially, rotation of latch ring 102 being prevented by pins 76. Thus, when hanger 38 is positioned with respect to wellhead housing 28 as shown in FIG. 2, as locking ring 104 is tightened onto threads 52, latch ring 100 is expanded into groove 68 of housing 28 thereby holding hanger 38 down with respect to housing 28.

After the cementing operation has been completed packoff assembly 100 is lowered into the well on running tool 130 to seal annulus 80 just above groove 68 in wellhead housing 28. Packoff assembly 100 includes an outer load ring 150, an actuating ring 151, inner load ring 152, inner retainer ring 154, outer packing ring 156, and inner packing ring 158.

Figure 3:
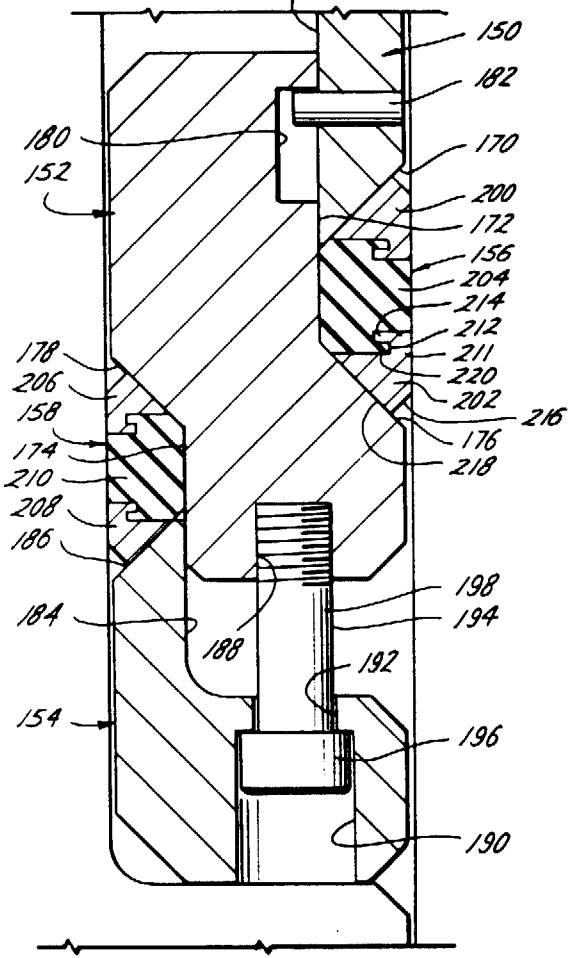
FIG. 3 is an enlarged section view of the seal assembly of FIG. 2.

Outer load ring 150 includes a reduced diameter portion 60 around its upper end and a counterbore 162 in its lower end. Actuating ring 151 has a counterbore 134 in its lower end for receiving reduced diameter portion 60 of outer load ring 150, and an internal J-slot 131 in its upper end to receive running tool 130. Bearing rings 161 are received by reduced diameter portion 160 to reduce friction with the lower end of actuating ring 151. Outer load ring 150 has an annular groove 166 which receives a plurality of pins 136 projecting through the internal wall of counterbore 134 of actuating ring 151. Outer load ring 150, and thus packing assembly 100, is mounted onto the lower end of actuating ring 151 by means of the engagement of pins 136 with the upper horizontal wall of annular groove 166 in ring 150. As best illustrated in FIG. 3, the lower terminus 170 of outer load ring 150 has a forty-five degree chamfer creating a downwardly and outwardly facing surface for engagement with outer packing ring 156.

Inner load ring 152 has a reduced diameter portion 172 at its upper end and a counterbore 174 in its lower end. Reduced diameter portion 172 forms a conical seat 176 at a forty-five degree angle with the external axial wall of portion 172. Conical seat 176 forms an upwardly and outwardly facing surface for engagement with outer packing ring 156. Counterbore 174 forms seat 178 having a forty-five degree angle with the internal axial wall of counterbore 174. The conical shoulder 178 has a downwardly and inwardly facing surface for engagement with inner packing ring 158. Reduced diameter portion 172 of inner load ring 152 is received within counterbore 162 of outer load ring 150. Outer load ring 150 and inner load ring 152 are connected together by means of an annular groove 180 in the axial wall of counterbore 172 of inner load ring 152 which receives a plurality of roll pins 182 projecting from the internal surface of the axial wall of counterbore 162 of outer load ring 150. As can be seen in FIG. 3, groove 180 has an axial length substantially greater than the diameter of pins 182 thereby permitting axial movement of outer load ring 150 with respect to inner load ring 152. The internal diameter of reduced diameter portion 172 of inner load ring 152 is greater than the outer diameter of mandrel 81 and the outer diameter of portion 172 is less than the inner diameter of counterbore 162 of outer load ring 150.

Referring again to FIG. 3, inner retainer ring 154 has a reduced diameter portion 184. The upper end of inner retainer ring 154 includes a conical seat 186 having a forty-five degree angle with the internal axial wall of ring 154, the seat having an upwardly and inwardly facing surface for engagement with inner packing ring 158. Reduced diameter portion 184 is received within lower counterbore 174 of inner load ring 152. Inner load ring 152 and inner retainer ring 154 are connected together by connection means which includes a plurality of downwardly facing countersinks 190 and a plurality of unthreaded passageways 192 through inner retainer ring 154, and a plurality of bolts 194 each having a head 196 disposed within a countersink 190 and a shaft 198 extending through a passageway 192 and threaded into a blind hole 188. The length of reduced diameter portion 184 when inserted into counterbore 174 produces a gap between inner load ring 152 and inner retainer ring 154 to permit axial movement of the compression members with respect to one another.

Referring again to FIG. 3, outer packing ring 156 includes metal rings 200, 202 and seal ring 204, and inner packing ring 158 includes metal rings 206, 208 and seal ring 210. Outer packing ring 156 is disposed between seat 176 on inner load ring 152 and seat 170 on outer load ring 150. Inner packing ring 158 is disposed between seat 186 on inner retainer ring 154 and seat 178 on inner load ring 152. Thus, outer packing ring 156 is compressed between outer load ring 150 and inner load ring 152, and inner packing ring 158 is compressed between inner load ring 152 and inner retainer ring 154.

Outer and inner packing rings 156, 158 are of common design wit the exception that inner packing ring 158 has smaller dimensions. Metal rings 206, 208 have smaller cross sections than metal rings 200, 202. The cross sections of rings 206, 208 each hve twenty percent less area, thus causing rings 206, 208 to contact the exterior wall of hanger 38 first upon actuation. Metal rings 200, 202 and 206, 208 also act as nonextrusion rings for seal rings 204, 210. Since the metal rings are of common design, it will be seen that a description of one will be a description of the others.

Metal ring 202 of outer packing ring 156 is made of metal to maintain a metal-to-metal seal with wellhead housing 28. Metal ring 202 includes a reduced diameter portion 211 having an annular channel 212 at the base of the axial wall of reduced diameter portion 211 creating annular lip 214. The lower annular corner facing wellhead housing 28 has been chamfered as at 216. Lower annular shoulder 218 contacting seat 176 is bevelled at a forty-five degree angle for engaging seat 176.

The lower chamfered shoulder 216 has eliminated the sharp corner to make it easier to handle, less susceptable to damage, and to increase the loading on the metal-to-metal seal using the same amount of force with less resisting metal. The chamfer at 216 reduces the metal-to-metal contact with the sealing surface of wellhead housing 28 to give a better metal-to-metal engagement.

Rubber seal rings 204, 210 are preferably an elastomer or rubber but may be of graphite or Teflon. Seal rings 204, 210 are backup seals in case the sealing surfaces of hanger 38 or wellhead housing 28 are scratched. These seals also provide resilience and flowability. Seal ring 204 has an opposing annular lip 220 for locking engagement with lip 214 upon the assembly of packing ring 158. The rubber seal rings 204, 210 may be bonded or molded to their respective metal rings 200, 202, 206, 208. The interlocking of the seal rings between the metal rings provides a larger bond area.

Referring now to FIG. 2, packoff assembly 100 is received over and centralized on the neck of hanger 38 and is housed in the bore of wellhead housing 28. The sealing surface 39 of hanger 38 is maintained clean so that a small inner diameter packoff assembly 100 may be used. However, ample inner diameter clearance is provided for assembly purposes and even greater clearance is provided on the outer diameter to avoid damage during remote installation within wellhead housing 28.

Figure 4A:
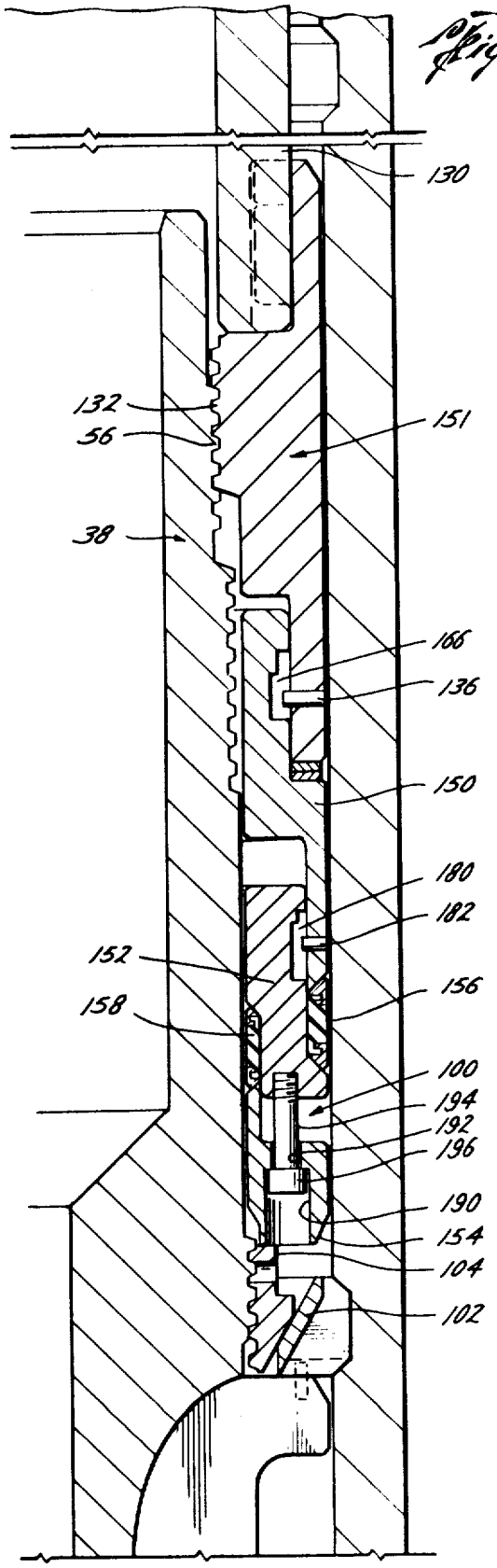
FIG. 4A is a section view of the seal assembly and environment shown in FIG. 4 but in the engaged position.
Figure 4B:
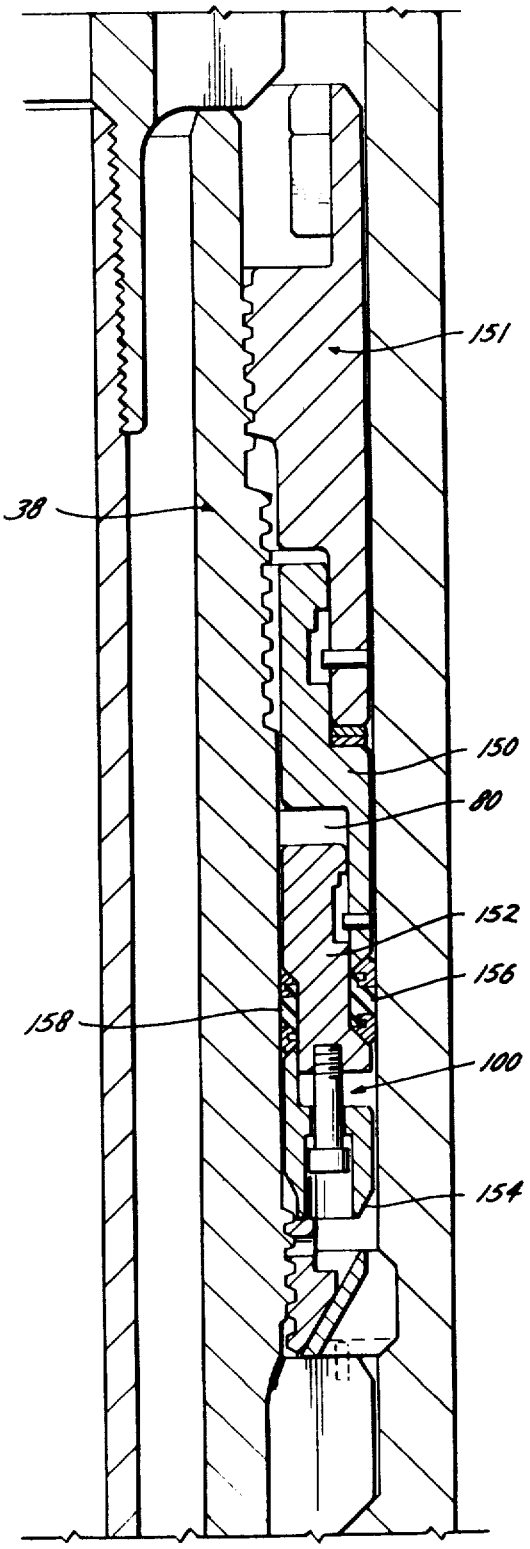
FIG. 4B is an enlarged view of the engaged seal assembly shown in FIG. 4A.

Referring now to FIGS. 4A and 4B showing packoff assembly 100 before and after actuation, the entire packoff assembly 100 is lowered into the well by means of a riser which is connected to running tool 130 which in turn supports packoff assembly 100. As the riser and packoff assembly 100 are lowered into the well, roll pins 136, 182 will bear against the upper surfaces of grooves 166, 180, respectively, and heads 196 of bolts 194 will bear against the upper surface of countersinks 190. In such a condition, packing rings 156, 158 are minimally compressed.

Referring now to FIG. 4A, as actuating ring 151 is threaded onto hanger 38 by threads 132 of ring 151 and upper threads 56 of hanger 38, the lower end of inner retainer ring 154 contacts the upper end of locking ring 104 whereby further axial movement of inner retainer ring 154 is prevented.

Referring now to FIG. 4B, further threading of actuating ring 151 onto hanger 38 causes further axial movement of outer load ring 150 with respect to inner retainer ring 154. Inner packing ring 158 contacts the sealing surface of hanger 38 first and because of its smaller cross section, provides a higher loading per unit area. Metal rings 206, 208 and 200, 202 compress seal rings 210, 204 respectively. Metal rings 206, 208 and 200, 202 also tend to elongate to create a metal-to-metal seal with the sealing surfaces of hanger 38 and wellhead housing 28.

It is important that outer packing ring 156 does not act as a brake during actuation. As can be seen, seal rings 156, 158 are loaded in series, and no additional O-rings are required. There is no potential leak path between the seals. The entire sealing force is applied through the outer diameter and inner diameter seal elements with the lower seal being loaded first. Upon completion of the threading of actuating ring 151 onto hanger 38, the packoff assembly 100 will be fully actuated and the seal of annulus 80 effected.

By virtue of inner load ring 152, the rate of compression of packing rings 156, 158 with respect to one another can vary. As a result, even when one seal assembly is fully compressed, compression of the other seal assembly may continue. In this way, both packing rings can be fully compressed even though the compression characteristic of such packing rings vary in size with respect to one another, and even when one packing ring is required to fill a larger gap than the other.

Figure 5:
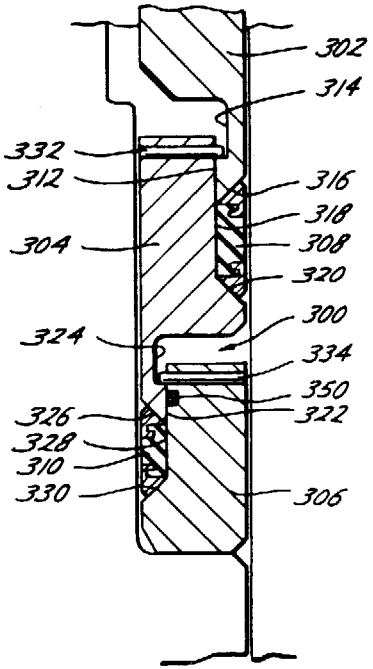
FIG. 5 is a section view of a first alternative embodiment of the seal assembly.

Referring now to an alternative embodiment of the sealing assembly shown in FIG. 5, alternative sealing assembly 300 includes an outer load ring 302, an inner load ring 304, an outer retainer ring 306, an outer packing ring 308 and an inner packing ring 310.

Outer load ring 302 includes a counterbore 312 having an internally facing annular groove 314. The lower tip of outer load ring 302 is bevelled to form a conical seat 316 having a downwardly and outwardly facing surface for engagement with packing ring 308.

Inner load ring 304 includes a reduced diameter portion 318 forming seat 320. Seat 320 has an upwardly and outwardly facing surface for engagement with packing ring 308.

Inner load ring 304 also includes a lower reduced diameter portion 322 having an outwardly facing annular groove 324. The lower tip of inner load ring 304 is bevelled to form a conical seat 326 having a downwardly and inwardly facing surface for engagement with lower packing ring 310.

Outer ring 306 includes a counterbore 328 forming a conical shoulder 330 with an upwardly and internally facing surface for engaging lower packing ring 310.

Inner load ring 304 is connected to outer load ring 302 and outer retainer ring 306 by means of roll pins 332, 334. Pin 332 projects outwardly at the upper end of ring 304 and is received by annular groove 314 in ring 302. Inner retainer ring 306 includes roll pin 334 projecting from its upper end into annular groove 324 in inner load ring 304.

Packing rings 308, 310 each include an upper metal ring, a lower metal ring and a seal ring having basically the same design as those in the preferred embodiment.

Outer retainer ring 306 includes an O-ring 350 to prevent leakage along seat 326.

Figure 6:
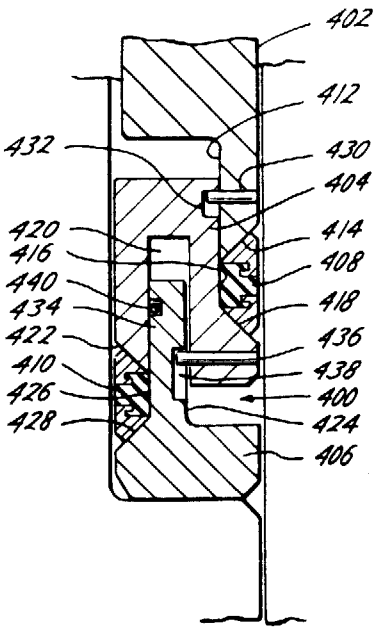
FIG. 6 is a section view of a second alternative embodiment of the seal assembly.

Referring now to FIG. 6 illustrating another alternative embodiment of the packoff assembly, packoff assembly 400 includes outer load ring 402, inner load ring 404, inner retainer ring 406, outer packing ring 408, and inner packing ring 410.

Outer load ring 402 includes a counterbore 412. The lower end of outer load ring 402 has a downwardly and outwardly facing seat 414 for engagement with outer packing ring 408.

Inner load ring 404 includes a reduced diameter portion 416 forming a lower seat 418 having an upwardly and outwardly facing surface for engagement with outer packing ring 408. Inner load ring 404 also includes an annular slot 420. A downwardly and internally facing seat 422 is located on the lower inner corner of inner load ring 404 for engagement with inner packing ring 410.

Inner retainer ring 406 includes a reduced diameter portion 424 and a counterbore 426. Counterbore 426 forms an upwardly internally facing seat 428 for engagement with lower packing ring 410.

Reduced diameter portion 416 of inner load ring 404 is received within counterbore 412 of outer load ring 402. Ring 404 is retained within counterbore 412 by inwardly projecting roll pins 430 received in an annular groove 432 around the axial wall of reduced diameter portion 416 of inner load ring 404. An annulal flange 434 is formed by reduced diameter portion 424 and counterbore 426 of inner retainer ring 406. Annular flange 434 is received in annular slot 420 of inner load ring 404. Inner retainer ring 406 is retained in inner load ring slot 420 by inwardly projecting load pins 436 being received in annular groove 438 around the axial wall of reduced diameter portion 424 of ring 406.

Outer packing ring 408 is captured between seat 414 of ring 402 and seat 418 of ring 404, and inner packing ring 410 is captured between seat 422 of ring 404 and seat 428 of ring 406. The configuration of this alternative embodiment reduces the overall height of the pack-off assembly. This is permitted by inner ring 404 being folded over to reduce its overall height.

An O-ring 440 is housed in an annular groove in the axial wall of counterbore 426 to prevent leakage around the upper metal ring of lower packing ring 410.

While a preferred embodiment of the invention has been shown and described, modifications thereof can be made by one skilled in the art without departing from the spirit of the invention.

I claim:

1. A sealing assembly for sealing the annulus between a hanger and a head, comprising:

an intermediate tubular member;

a lower tubular member disposed below and reciprocably mounted on said intermediate tubular member;

an upper tubular member disposed above and reciprocably mounted on said intermediate tubular member;

first sealing means disposed on said lower tubular member and engageble with said intermediate tubular member for sealing enggement with the hanger;

second sealing means independent of said first sealing means disposed on said intermediate tubular member and engageable with said upper tubular member for sealing engagement with the head; and compression means for compressing said lower, intermediate and upper tubular members together, said first and second sealing means sealingly engaging the hanger and head in series whereby said second sealing means may be further compressed between said upper and intermediate tubular members after the compression of said first sealing means between said lower and intermediate members has been completed.

2. The assembly of claim 1 wherein said first sealing means includes a first sealing element disposed between first metal members and said second sealing means includes a second sealing element disposed between second metal members, the axial projected area of said first sealing element and metal members being less than the axial projected area of said second sealing element and metal members.

3. The assembly of claim 2 wherein the axial projected area of said first sealing means is sized with respect to the axial projected area of said second sealing means whereby said first sealing means will sealingly engage the hanger before said second sealing means sealingly engages the bore of the head.

4. The assembly of claim 2 wherein said first metal members are bonded to said first sealing element and said second metal members are bonded to said second sealing element along cooperating tongue and grooves.

5. The assembly of claim 4 wherein said first and second metal members have a triangular cross section with an additional L-shaped cross section forming tongue and grooves.

6. The assembly of claim 2 wherein said first metal members include first upper and lower metal rings having frustoconical shoulders facing away from said first sealing element and said second metal members include second upper and lower metal rings having frustoconical shoulders facing away from said second sealing element.

7. The assembly of claim 6 wherein said lower and intermediate tubular members have tapered surfaces for cooperatively engaging the frustoconical surfaces of said first metal rings, and said intermediate and upper tubular members have tapered surfaces for cooperatively engaging the frustoconical surfaces of said second metal rings.

8. The assembly of claim 7 wherein said first and second metal rings have chamfered annular corners facing the sealing surfaces of the hanger and head.

9. The assembly of claim 1 further including actuation means for applying a force on said compression means for compressing said lower, intermediate, and upper tubular members against the hanger.

10. The assembly of claim 9 wherein said actuation means is threadingly engaged to the hanger whereby the rotation of said actuation means applies a downward force on said compression means.

11. The assembly of claim 2 wherein said intermediate and lower tubular members have tapered surfaces cooperatively engaging frustoconical shoulders on said first metal members of said first sealing means whereby upon the downward movement of said intermediate tubular member with respect to said lower member, said first metal members form a metal-to-metal seal with said hanger and compress said first sealing element to cause sealing engagement with said hanger.

12. The assembly of claim 2 wherein said upper and intermediate tubular members have tapered surfaces cooperatively engaging frustoconical shoulders of said second metal members of said second sealing means whereby upon the downward movement of said upper tubular member with respect to said intermediate tubular member, said second metal members from a metal-to-metal seal with said bore and compress said second sealing element to cause sealing engagement with said bore.

13. The assembly of claim 1 wherein said intermediate tubular member has an upper reduced diameter portion and a lower counterbore, and said upper and lower members each have a skirt, the skirt of said lower tubular member being received by said lower counterbore and the skirt of said upper tubular member receiving said reduced diameter portion.

14. The assembly of claim 13 wherein first sealing means is disposed between the end of the sirt of said lower tubular member and the bottom of said counterbore and said second sealing means is disposed between the end of the skirt and said upper tubular member and an annular shoulder on said intermediate tubular member.

15. The assembly of claim 1 wherein said intermediate tubular member has a skirt received in a counterbore of said lower tubular member, said first sealing means being disposed between the end of said sirt and the bottom of said counterbore.

16. The assembly of claim 1 wherein said intermediate tubular member has an annular slot and a reduced diameter portion adjacent said slot and said upper and lower tubular members have skirts, the skirt of said upper tubular member receiving said reduced diameter portion and the skirt of said lower tubular member being received by said annular slot.

17. A sealing assembly for sealing the annulus between a hanger and a wellhead, comprising:

a first annular member;

a second annular member attached to said first annular member by first connection means, said first connection means attaching said first and second annular members together and allowing relative axial movement therebetween, said first and second annular members forming a first annular collapsible channel therebetween for facing the wellhead;

a first annular sealing element disposed in said first annular collapsible channel and adapted for sealing engagement with the wellhead;

a third annular member attached to said second annular member by second connection means, said second connection means attaching said second and third annular members together and allowing relative axial movement therebetween, said second and third annular members forming a second annular collapsible channel therebetween for facing the hanger;

a second annular sealing element disposed in said second annular collapsible channel and adapted for sealing engagement with the hanger;

compression means for compressing said first, second, and third annular members causing said first and second annular collapsible channels to shorten and compress said first and second annular sealing elements;

said second annular sealing element preventing said second annular collapsible channel from shortening a distance which would prevent relative axial movement between said second and third annular members; and said first annular sealing element preventing said first annular collapsible channel from shortening a distance which would prevent relative axial movement between said first and second annular members, the compression from said first and third annular members being transmitted to said second annular member through said first and second annular sealing elements.

* * * * *